US007048249B2

(12) United States Patent
Jaruzel et al.

(10) Patent No.: US 7,048,249 B2
(45) Date of Patent: May 23, 2006

(54) CIRCULAR FORMWORK

(75) Inventors: Kurt Jaruzel, Hasjach i.K. (DE); Josef Griessbaum, Hofstetten (DE)

(73) Assignee: Paschal-Werk G. Maier GmbH, Steinach (DE)

( * ) Notice: Subject to any disclaimer, the term of this patent is extended or adjusted under 35 U.S.C. 154(b) by 0 days.

(21) Appl. No.: 10/525,167

(22) PCT Filed: Aug. 29, 2003

(86) PCT No.: PCT/EP03/09586

§ 371 (c)(1),
(2), (4) Date: Feb. 22, 2005

(87) PCT Pub. No.: WO2004/025050

PCT Pub. Date: Mar. 25, 2004

(65) Prior Publication Data

US 2005/0263672 A1 Dec. 1, 2005

(30) Foreign Application Priority Data

Sep. 2, 2002 (DE) ..... 102 40 372

(51) Int. Cl.
*E04G 11/00* (2006.01)
*E04G 17/00* (2006.01)

(52) U.S. Cl. ..... 249/18; 249/4; 249/20; 249/194; 249/212

(58) Field of Classification Search ..... 249/1, 249/4, 17, 18, 20, 40, 48, 188–191, 194, 249/212
See application file for complete search history.

(56) References Cited

U.S. PATENT DOCUMENTS

| | | | | | |
|---|---|---|---|---|---|
| 4,619,433 | A | | 10/1986 | Maier | |
| 4,729,541 | A | * | 3/1988 | Maier | 249/17 |
| 5,125,617 | A | * | 6/1992 | Miller | 249/18 |
| 5,492,303 | A | | 2/1996 | Jaruzel | |
| 5,669,188 | A | * | 9/1997 | Jaruzel | 249/210 |
| 2002/0139917 | A1 | * | 10/2002 | Arozena Bergaretxe | 249/189 |

FOREIGN PATENT DOCUMENTS

| | | | | |
|---|---|---|---|---|
| DE | 24 26 708 | | 12/1975 | |
| DE | 88 15 339.8 | | 5/1989 | |
| JP | 3841579 | * | 6/1990 | 240/20 |

* cited by examiner

*Primary Examiner*—Jong-Suk (James) Lee
(74) *Attorney, Agent, or Firm*—Volpe and Koenig, P.C.

(57) ABSTRACT

Disclosed is a formwork element (1) which can be assembled with other formwork elements (1) so as to form a formwork structure. A formwork shell (4) having an adjustable curvature is supported by means of back supports (5) so as to create a stiff formwork element (1) that sustains concreting pressure. The supports (5) have a preferably trapezoidal cross section and are provided with fastening flanges (6) on the edges thereof and at least one girder (7) that is located at a distance from the formwork shell (4). The length of the girder (7) is adjustable in order to set or modify the curvature of the formwork shell (4) which is mare of steel or plastic. Intermediate pieces (9) are disposed between the fastening flanges (6) of the supports (5) and the formwork shell (4). The fastening flanges (6) are fixed to said intermediate pieces (9) so as to be pivotable or tiltable relative thereto about the longitudinal direction thereof. The cross section of the flanges and/or the intermediate pieces (9,12) having a convex shape or being provided with slopes (61).

11 Claims, 2 Drawing Sheets

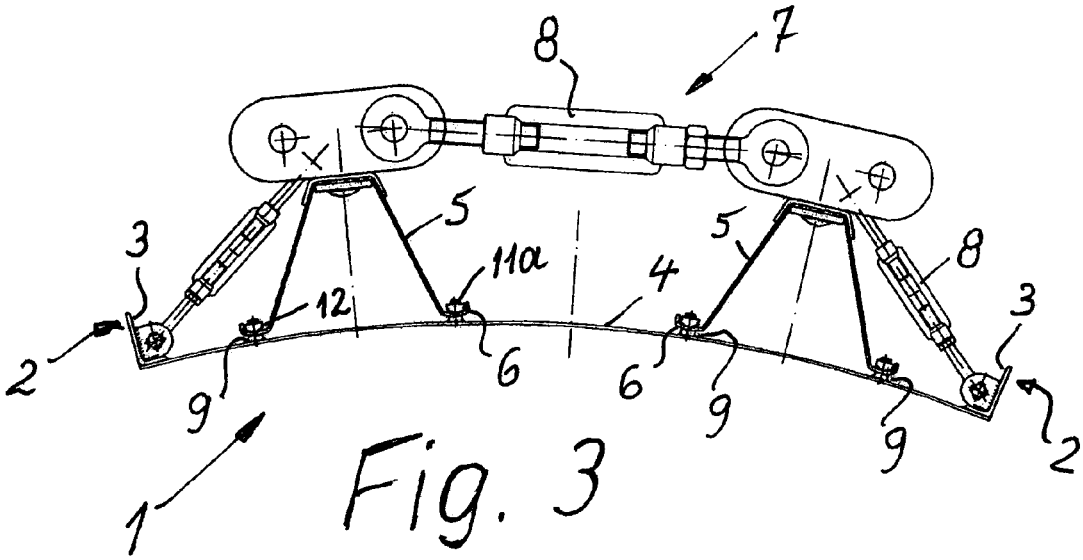
Fig. 3
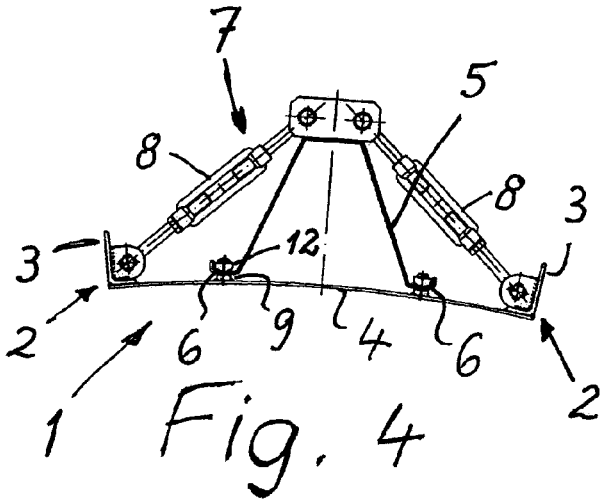
Fig. 4
Fig. 5
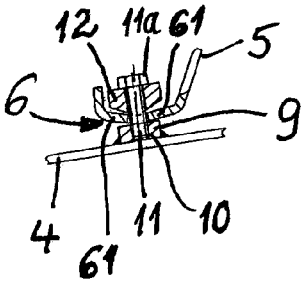

CIRCULAR FORMWORK

BACKGROUND

The invention relates to a circular formwork with at least one formwork work element, which has a formwork shell having an adjustable curvature and which has braces and/or at least one support, which supports the formwork shell, which has a U-shaped, V-shaped, or trapezoidal cross section that is open to the supported formwork shell and which has fastening flanges on its edges facing the formwork shell for connecting to the rear side of the formwork shell, and with a girder attaching to the braces and to the support or supports at a distance from the formwork shell, wherein the effective length of the girder is adjustable in order to change the curvature of the formwork shell.

Such a formwork with several supports acting as reinforcement, as well as with edge crosspieces similarly acting as reinforcements, is known from DE 24 26 708 C3 or EP 0 514 712 B1 and has proven to be effective. In the formwork and the formwork elements according to DE 24 26 708 C3, the girder attaches to each support, but not to the edge crosspieces, while in the formwork according to EP 0 514 712 B1, there is also a girder between a support near the edge and another reinforcement in the form of an edge crosspiece and the girder has an adjustable effective length.

Here, the support is attached with screws engaging directly in the formwork shell, that is, such an attachment is possible only when the formwork shell has a sufficient thickness. In addition, for the case, in which the screw head is countersunk into the surface of the formwork shell facing the concrete, a corresponding mark is later produced on the concrete surface.

In a formwork shell composed of wood or laminated wood, this shell is also exposed to relatively high wear and tear.

Such a formwork is also known from U.S. Pat. No. 4,619,433, wherein the fastening flanges of the support have an obtuse-angled cross section and the fastening screws engage in the point of this angle. According to the size of the screw head or the nut and/or a plain washer, the flanges are more or less straightened and if necessary pressed into a wooden plate.

SUMMARY

Therefore, there is the objective of providing a formwork of the type mentioned in the introduction, in which marks by fastening means in the concrete can be prevented at least to a large degree or completely and in which the curvature of the formwork shell can be set or adjusted also between the flanges of a support with a U-shaped, V-shaped, or trapezoidal cross section as much as possible without deviations or as much as possible in agreement with adjacent areas of the formwork shell.

To meet this objective, intermediate pieces are arranged between the flanges of the support and the formwork shell and the flanges of the support are fixed to these intermediate pieces so as to be pivotable or tiltable about the longitudinal direction of these intermediate pieces.

Through the possible relative tilting or pivoting of the flanges on the intermediate pieces, it can be achieved that by setting or adjusting a curvature of the formwork shell between the two flanges of such a support, the desired curvature is set, although the cross section of the support actually forms with the formwork shell a closed hollow profile, which would have too great a stiffness for such a setting or adjustment without the arrangement according to the invention.

Through the relative pivoting ability between the flanges of the support and the intermediate piece on its side fixed to the formwork shell, the possibility is preserved to curve the formwork shell—also between the two flanges of the support—by adjusting the girder or to modify the curvature. Through the configuration according to the invention, it is thus prevented that kinks or undesired deviations from the desired curvature appear when the formwork shell is curved in its profile, especially in the region of flanges of the support.

The intermediate piece, which is fixed to the outer side of the formwork shell, also enables for a relatively thin formwork shell a large penetration depth for a fastening element, so that this element can be attached from the side facing away from the concreting side and the surface of the formwork shell facing the concrete can remain uninterrupted also in the region of the fastening, so that marks caused by fastening elements in the concrete can be avoided.

The intermediate pieces can have threaded holes, in which the fastening screws or fastening bolts passing through the flanges of the support can be screwed into and/or fastening bolts, which pass through fastening holes in the flanges of the support, can be arranged on or fixed to the intermediate pieces. Thus, the supports can be connected by means of screw connections to the intermediate pieces arranged on their side to the formwork shell.

To be able to realize a good transfer of the reinforcing effect of the supports to the formwork shell, it is preferable when the intermediate pieces are connected.

To be able to realize a good transfer of the reinforcing effect of the supports to the formwork shell, it is preferable when the intermediate pieces each have several threaded holes arranged in a row and/or fastening bolts for several fastening holes provided on a common flange for a flange of a support. In this way, the intermediate pieces can be formed with a bar shape and can extend over at least one part of the longitudinal extent of a corresponding flange of a support. The connection between the support and formwork shell is correspondingly long and a correspondingly good transfer of the reinforcing effect is realized.

A best-possible reinforcement of the formwork shell by each support can be achieved when the intermediate pieces are each essentially as long as the support and/or its flange. Thus, in such a preferred embodiment, each intermediate piece can practically support the entire flange profile in a tiltable way.

The formwork shell can comprise wood, plastic, metal, iron, and/or steel. Here, the arrangement of intermediate pieces, above all for a formwork shell made from metal, especially steel, as especially advantageous, because not only does the total thickness composed of the formwork shell and the intermediate piece produce a correspondingly large engagement length for a fastening element, but for a formwork shell made from steel, in connection with the flanges of a V-shaped, U-shaped, or trapezoidal support for direct, opposite fastening, for example, by welding, a hollow profile would be formed, in which the portion belonging to the formwork shell could not be changed at all or barely in its curvature for an adjustment of the girder length. Through the intermediate pieces according to the invention and the fastening of the flanges that can pivot or tilt on such intermediate pieces, also for such a formwork shell, the adjustability of the curvature itself is preserved in the region between the flanges of the support in an advantageous way.

The intermediate pieces are preferably connected or—for a formwork shell made from metal, iron, or steel, likewise comprising metal, iron, or steel—welded to the back side of the formwork shell. This leads to a best-possible connection also of the intermediate pieces to the formwork shell, so that an overall good transfer of the forces to be guided into the support can be achieved.

The pivoting or tilting ability according to the invention can be realized, such that the side of the intermediate piece facing the flange has a convex curved cross section or is inclined with a bevel on both sides of the fastening points and/or the bottom side of the flange of the support has a convex curve or is provided with slopes receding from the middle outwards relative to the intermediate piece. Here, an economical production provides a flat surface of the intermediate piece and a bottom side of the associated flange that is curved or inclined towards two sides, so that as the intermediate piece, a bar with a very simple cross section is produced, while the support can be provided in its production equally with the corresponding cross-sectional shape of the flange. Thus, at the contact point between intermediate piece and flange, in each case an intermediate space, which increases outwards from the contact or fastening point and which thus allows mutual tilting about the longitudinal direction.

The projection contacting the flange on the side facing away from the formwork shell, the screw head, a nut, and or an intermediate part located between the screw head or nut and flange can have a cross section receding outwards from the middle region on the side facing the flange. For example it can be rounded or beveled. Therefore, the relative movement between intermediate piece and flange especially in the region of the fastening points is not limited by the actual fastening element. Instead, in this way the relative pivoting or tilting between intermediate piece and flange can be realized practically unimpaired also at the corresponding engaging points of the fastening elements.

The intermediate pieces formed especially as bars can be formed symmetric to their longitudinal center. Thus, they can be attached in practically any orientation to the formwork shell, that is, a preferred position and direction does not have to be followed for their fastening to the formwork shell, which simplifies the assembly.

The bar-shaped intermediate pieces can have an approximately rectangular cross section, wherein the side of the rectangle facing the flange of the support can be curved convexly and/or can be beveled or formed with a sector or semicircular shape going out from the middle region and a flattened or flat region of the cross section can contact the outer side of the formwork shell. In another alternative, for which the surface of the bar-shaped intermediate piece facing away from the formwork shell is also formed flat with reference to a corresponding shaping of the associated flange of the support, the intermediate piece itself can also be shaped such that the ability to pivot or tilt is produced for an optionally flat flange.

Above all for the combination of individual or several of the features and measures described above, a formwork is given for curved surfaces with a curvature that can be set or changed, for which the formwork made from metal, plastic, or wood has a long service life and high loading capacity and nevertheless the advantageous supports with a U-shaped, V-shaped, or preferably trapezoidal cross section can be used, which are closed on their side facing the formwork shell by this shell into a kind of box profile. Despite this formation of a hollow or box profile, the formwork shell can be adapted also between the flanges of a support to the corresponding curvature, because due to the intermediate piece located between the shell and the flanges and the ability of the flange to pivot or tilt thereon, the formwork shell can be bent or curved also between these flanges or can be changed in its bending. Simultaneously, parts of the fastening elements that are visible on the side facing the concrete and that cause marks in the concrete are prevented.

BRIEF DESCRIPTION OF THE DRAWINGS

An embodiment of the invention is described in more detail below with reference to the drawing. Shown in partially schematized representation are:

FIG. 3 an enlarged scale, plan view of a formwork element of the formwork according to the invention with curved formwork shell that is adjustable with reference to its curvature with edge cross pieces acting as reinforcements and two supports, FIG. 4 a view according to FIG. 3 of a formwork element with two edge crosspieces reinforcing parallel edges and a support arranged in-between with trapezoidal cross section, as well as FIG. 5 a cross sectional view of a flange of a support arranged on the back side of the formwork shell for its reinforcement in the region of its fastening flange, which is fixed to the side of an intermediate piece facing away from the formwork shell so that it can pivot or tilt.

DETAILED DESCRIPTION OF THE PREFERRED EMBODIMENTS

Figure 1:
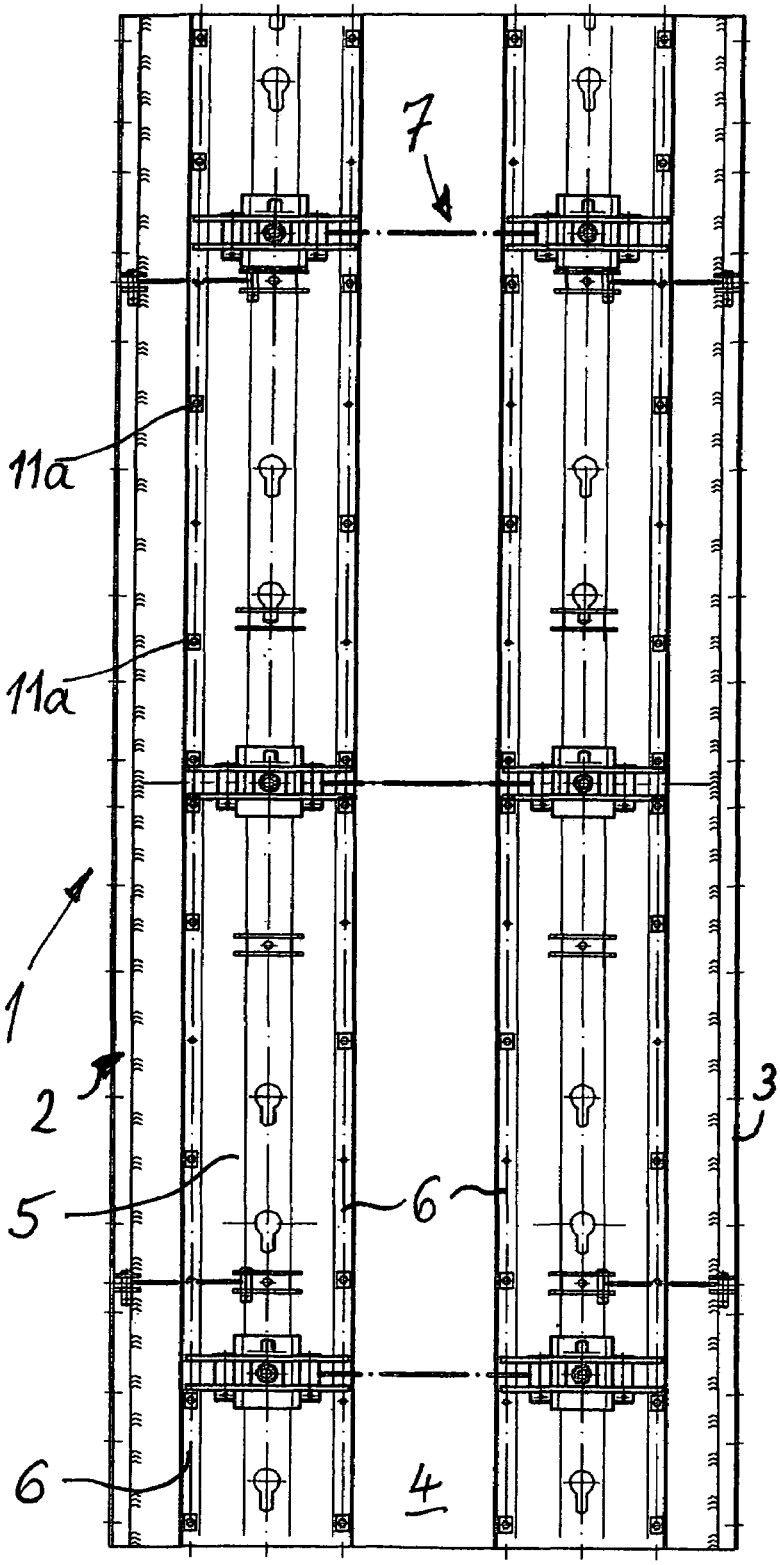
FIG. 1 a view of the back side.

FIGS. 1 to 4 show a formwork element designated as a whole with 1 for a formwork for curved surfaces, that is, such a formwork can be assembled from several such formwork elements 1, wherein fastening webs 3 also acting as reinforcements for the formwork shell at the vertical edges 2 for mutual connection of such formwork elements 1 are provided. Here, the formwork shell 4 is curved according to FIG. 3 and can be set or adjusted with reference to its curvature.

The formwork element 1 also has according to FIG. 4 at least one, according to FIG. 3 two—optionally also more—supports 5, which support the formwork shell 4 in addition to the fastening webs 3 and which have in the embodiment according to FIGS. 3 and 4 an approximately trapezoidal cross section, which is open towards the supported formwork shell 4 and in connection with the formwork shell 4 practically forms a hollow cross section.

The support or supports 5 have fastening flanges 6 on their edges facing the formwork shell 4, wherein such a fastening flange 6 is shown especially clearly in FIG. 5. Here, one can see that the free edge of this flange 6 is bent away from the formwork shell 4. These fastening flanges 6 are used in a way still to be described for connecting the support 5 to the formwork shell 4.

Figure 2:
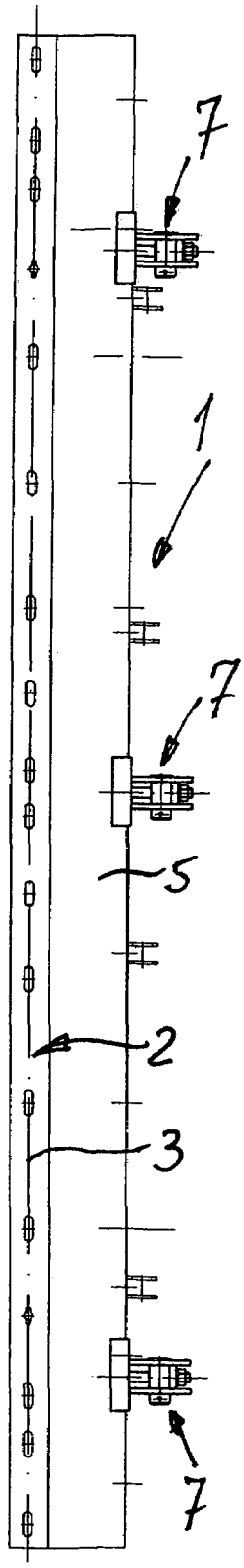
FIG. 2 a side view.

For the already mentioned setting of the curvature of the formwork shell 4 and as additional reinforcement of the formwork element 1, there is a girder 7, in the embodiment according to FIGS. 1 and 2 even three girders 7, attached to the support or supports 5 at a distance to the formwork shell 4 and to the fastening webs 3 also acting as supports or reinforcements, wherein the effective length of this girder 7 is adjustable by means of one or more tensioning screws 8 thereof for changing the curvature of the formwork shell 4, similar to a large-area formwork according to DE 24 26 708 C3 or EP 0 514 712 B1.

The formwork shell 4 is made from metal, especially steel, plastic, or wood and allows high loading due to its strength or optionally its thickness.

Nevertheless, so that the curvature can also be provided between the fastening flanges 6 and can be changed approximately in the same way as outside of a support cross section, intermediate pieces 9 are arranged between the fastening flanges 6 and the formwork shell 4 according to FIGS. 3 and 4 and above all according to FIG. 5 and the fastening flanges 6 of the support 5 are fixed to said intermediate pieces so as to be pivotable or tiltable relative thereto about the longitudinal direction thereof, so that the formwork shell 4 can perform together with the corresponding intermediate pieces 9 relative to the corresponding fastening flange 6 a corresponding relative motion for the change of its curvature.

According to FIG. 4, the intermediate pieces 9 have threaded holes 10, in which the fastening screws 11 or fastening bolts passing through the flanges 6 of the support 5 can be screwed in, as one can see clearly in FIG. 4. Thus, the direct engagement of a corresponding fastening element to the formwork shell 4 is prevented, that is, the intermediate piece 9 obtains an additional function.

In a preferred embodiment, the intermediate pieces 9 are essentially as long as the associated support 5 and/or its flange 6, so that the cross section shown in FIG. 5 is given over the entire length of the support 5. Here, according to FIG. 1 the intermediate pieces 9 each have for a flange 6 of a support 5 several threaded holes 10 arranged in a row corresponding to the number of fastening screws 11. However, it would also be conceivable for the intermediate pieces 9 of a fastening flange 6 to be interrupted and arranged only in the region of the fastening screws 11. However, a continuous intermediate piece 9, which is advantageously formed with a bar shape, improves the reinforcement and the transfer of forces between formwork shell 4 and support 5.

The intermediate pieces 9 are connected to the back side of the formwork shell 4 according to FIG. 5 and welded, if both are made from metal, preferably from iron or steel.

So that between the fastening flanges 6 and the formwork shell 4 or the intermediate pieces 9 the relative pivoting or tilting ability about an axis running in the longitudinal direction of the corresponding flange 6 is possible, the bottom side of the flange 6 is curved approximately convexly according to FIG. 4 or provided with slopes 61 receding outwards from the middle relative to the intermediate piece 9. With reference to FIG. 4, one can clearly see that the flange 6 can swing on the intermediate piece 9 due to these slopes 61, that is, conversely, the intermediate piece 9 with the formwork shell 4 located thereon can perform corresponding movements if the curvature of the formwork shell 4 is changed, without the flange 6 and the support 5 impairing or even preventing these movements.

This relative mutual movement or pivoting is even further simplified in that the projection or screw head 11*a* or in the embodiment an intermediate part 12 located between a screw head 11*a* and flange 6 taking hold of the flange 6 on the side facing away from the formwork shell 4 has a cross section receding outwards from its middle region on the side facing the flange 6, for example, it is rounded or beveled in opposite directions—as can be seen in the embodiment. Therefore, the slopes 61 of the flange 6 can move freely as much as possible between the intermediate piece 9 and this intermediate part 12 and can thus be pivoted or tilted correspondingly, that is, conversely, the formwork shell can perform a corresponding pivoting or tilting motion relative to the flange 6 when its curvature is changed. Thus it is prevented that between the two flanges 6 of a support 5, the formwork shell 4 cannot follow a change of the curvature.

In the preferred embodiment, the intermediate pieces 9 are formed as bars and are symmetric to their longitudinal center, so that they can be attached in any orientation. Here, the cross section is rectangular, but it could also be curved convexly and beveled and formed with a sector or even semicircular shape on the side facing the flange 6 so as to enable the already described relative pivoting motion between the intermediate piece 9 and the flange 6.

Thus, the formwork shell 4 can be changed with the help of the girder 7 and the tensioning screw 8 with reference to its curvature, without such a change of the curvature being stopped, especially between the flanges 6 of a corresponding support 5 due to the fixing thereon and therefore becoming irregular over the cross section of the formwork shell 4. Despite the reinforcement of the formwork shell 4 with the supports 5 engaging by means of flanges 6, the formwork shell 4 can be set or adjusted in its curvature, wherein this change also continues between the flanges 6 of a support 5, because the formwork shell can perform tilting or pivoting motions relative to the flanges corresponding to their associated curvature despite the indirect connection of the shell to the flanges 6. Here, it is useful that the curvature center points lie on an axis, which runs parallel to the longitudinal direction of the support.

The formwork element 1 can be built into a formwork with other such formwork elements 1. Here, a formwork shell 4, which has an adjustable curvature and which is supported by back-side supports 5, is provided in order to create a stiff formwork element 1 that can withstand the concreting pressure. The supports 5, which preferably have a trapezoidal cross section, have fastening flanges 6 at their edges and are provided at a distance to the formwork shell 4 with at least one girder 7, whose length is adjustable for setting or changing the curvature of the formwork shell 4. The formwork shell 4 is made preferably from steel or plastic or wood and there are intermediate pieces 9 between the fastening flanges 6 of the support 5 and the formwork shell 4, wherein the fastening flanges 6 are fixed to said intermediate pieces so as to be pivotable or tiltable relative thereto about the longitudinal direction thereof; the cross section of the flanges 6 and/or the intermediate pieces 9 and/or 12 having a convex shape or being provided with slopes 61.

The invention claimed is:

1. A circular formwork comprising at least one formwork element (1), which has a formwork shell (4) with an adjustable curvature and which has a reinforcement and at least one support (5) supporting the formwork shell (4), the at least one support having a U-shaped, V-shaped, or trapezoidal cross section open towards the supported formwork shell (4) and fastening flanges (6) located on ends thereof facing the formwork shell (4) for connecting to a back side of the formwork shell (4), and a girder (7) engaged to the reinforcement and the at least one support (5) at a distance to the formwork shell (4), wherein an effective length of the girder (7) is adjustable for changing the curvature of the formwork shell (4), and intermediate pieces (9) located between the fastening flanges (6) of the support (5) and the formwork shell (4) and the fastening flanges (6) of the support (5) are fixed to the intermediate pieces so as to be pivotable or tiltable about a longitudinal direction of the intermediate pieces.

2. The circular formwork according to claim 1, wherein the intermediate pieces (9) have threaded holes (10), in which fastening screws (11) or fastening bolts passing through the flanges (6) of the support (5) can be screwed in and/or fastening bolts, which pass through fastening holes in the flanges of the support, arranged on or fixed to the intermediate pieces.

3. The circular formwork according to claim 1, wherein the intermediate pieces (9) each have several threaded holes (10) arranged in a row for the flange (6) of the support (5) and/or fastening bolts for several fastening holes provided in a common flange.

4. The circular formwork according to claim 1, wherein the intermediate pieces (9) are formed with a bar shape and extend over at least a part of a longitudinal extent of the corresponding flange of the support.

5. The circular formwork according to claim 1, wherein the intermediate pieces (9) are each generally as long as the support (5) and/or the flange (6) thereof.

6. The circular formwork according to claim 1, wherein the formwork shell (4) is made from metal, iron, steel, wood or plastic.

7. The circular formwork according to claim 1, wherein the intermediate pieces (9) are connected or welded to the back side of the formwork shell (4).

8. The circular formwork according to claim 1, wherein a side of the intermediate piece (9) facing the flange (6) has a convexly curved cross section or is inclined with a bevel on both sides of fastening points to the flange (6) and/or a bottom side of the flange (6) of the support (5) is curved convexly or is provided with slopes (61) receding outwards from a middle region relative to the intermediate piece (9).

9. The circular formwork according to claim 1, wherein a projection, screw head, nut, and/or intermediate part (12) located between the screw head (11*a*) or nut and the flange (6) contacting the flange (6) on a side facing away from the formwork shell (4) has a cross section receding outwards from a middle region thereof on a side facing the flange (6).

10. The circular formwork according to claim 1, wherein the intermediate pieces (9) are formed as bars are formed symmetric to a longitudinal center thereof.

11. The circular formwork according to claim 10, wherein the bar-shaped intermediate pieces (9) have an approximately rectangular cross section, wherein a side of the rectangle facing the flange of the support (5) is curved convexly and/or beveled or has a sector or semicircular shape on both sides from a middle region and a flattened or flat region of the cross section contacts the back side of the formwork shell (4).

* * * * *